US005603775A

United States Patent [19]

Sjöberg

[11] Patent Number: 5,603,775

[45] Date of Patent: Feb. 18, 1997

[54] UTILIZATION OF A SUCTION NOZZLE AND JET NOZZLE FOR CLEANING MOVING OBJECTS

[76] Inventor: Staffan Sjöberg, Sulfitvägen 4, S-666 00 Bengtsfors, Sweden, SE

[21] Appl. No.: 436,229

[22] PCT Filed: Nov. 24, 1993

[86] PCT No.: PCT/SE93/01012

§ 371 Date: May 17, 1995

§ 102(e) Date: May 17, 1995

[87] PCT Pub. No.: WO94/12349

PCT Pub. Date: Jun. 9, 1994

[30] Foreign Application Priority Data

Nov. 25, 1992 [SE] Sweden ..... 9203538

[51] Int. Cl.[6] ..... B08B 3/02; B08B 5/04; A47L 5/14

[52] U.S. Cl. ..... 134/21; 134/23; 134/32; 134/122 R; 134/153; 15/302; 15/345

[58] Field of Search ..... 134/21, 15, 23, 134/25.5, 32, 122 R, 153; 15/302; 7/345

[56] References Cited

U.S. PATENT DOCUMENTS

| | | | |
|---|---|---|---|
| 3,574,139 | 4/1971 | Sollerud | 134/21 X |
| 3,737,940 | 6/1973 | Moestue et al. | 15/302 |
| 3,956,790 | 5/1976 | Ishiwata et al. | 15/302 |
| 4,025,984 | 5/1977 | Hoener, Jr. | 15/302 |
| 4,611,553 | 9/1986 | Iwata et al. | 15/302 |
| 4,751,759 | 6/1988 | Zoell | 15/345 X |
| 5,158,101 | 10/1992 | Sakka | 134/167 R |
| 5,335,681 | 8/1994 | Schmid | 134/64 R |

FOREIGN PATENT DOCUMENTS

| | | |
|---|---|---|
| 514670 | 11/1992 | European Pat. Off. . |
| 63-4947 | 1/1988 | Japan . |

*Primary Examiner*—Jill Warden
*Assistant Examiner*—Saeed Chaudhry
*Attorney, Agent, or Firm*—Nixon & Vanderhye P. C.

[57] ABSTRACT

Cleaning apparatus, and a method of utilization of the apparatus, cleans an object with a moving surface, such as a roll. The cleaning apparatus includes a nozzle head with a suction nozzle and a jet nozzle for emitting a liquid jet towards the roll. A sub-pressure is maintained in a chamber of the suction nozzle in order to evacuate liquid and released impurities with the aid of air flowing through a gap between the roll and the orifice edge. The jet nozzle is spaced from the inside of the suction nozzle and at the center of the suction nozzle to form a circumferential passage, the passage communicating with an evacuation pipe. The nozzle head also includes a structure to supply compressed air into the chamber through the gap in order to encounter and carry with it toward the passage liquid and impurities, cooperating with the suction effect maintained in the chamber and the evacuation pipe. The compressed air also has the advantage of drying the roll treated with liquid.

20 Claims, 5 Drawing Sheets

UTILIZATION OF A SUCTION NOZZLE AND JET NOZZLE FOR CLEANING MOVING OBJECTS

The present invention relates to apparatus for cleaning the surfaces of objects in movement, comprising at least one nozzle head including a housing forming an elongate suction nozzle that terminates in an orifice edge surrounding an opening, which suction nozzle contains a chamber including said opening, the suction nozzle being arranged spaced from said surface to form a circumferential gap between the surface and the orifice edge of the suction nozzle, the nozzle head also including at least one jet nozzle arranged in said chamber spaced from said opening in order to emit a jet of a treating liquid to produce a predetermined treatment area on said surface; pipe means including an evacuation pipe connected to the chamber of the suction nozzle, a supply pipe connected to the jet nozzle to supply treating liquid under pressure, and a vacuum source arranged to maintain a subpressure in the chamber so as, with the aid of air flowing in through said gap, to evacuate liquid and material released from the surface; and an actuator to move the nozzle head substantially perpendicularly to the direction of movement of the object, said nozzle head being arranged to be guided along the moving surface at a constant distance therefrom in order to maintain said gap.

The function of a roll rotating in contact with a material web is gradually deteriorated by material collecting on the shell surface of the roll. The degree of deterioration of the roll function varies from one area to another as well as the type of material and quantity thereof that collects. An example of such rolls is cliche rolls where printing ink adheres to the shell surface and collects so that the quality of the pattern to be transferred to the material web passing it is deteriorated. Also contributing to this deterioration is the fact that dirt and fibres collect in the ink layer and that this ink layer may be uneven both peripherally and in axial direction, the deterioration therefore appearing unevenly. One alternative for restoring the function of the roll has been to stop production in order to clean the shell surface by various means. Since falls in the production are not desirable, another alternative has been to use stationary aids such as brushes and scrapers to try to clean the shell surface during operation. Both alternatives are time consuming and troublesome to perform because the space around the roll is usually rather cramped. The latter alternative also means that brushes and scrapers become worn and their cleaning effect is in time reduced and they must be replaced at regular intervals. Material is collected in the brushes and they must also be cleaned. If scrapers are used they will wipe over some of the material when larger quantities have built up on the shell surface, and this material then remains. Cleaning in accordance with the first alternative must then be performed and continuous operation is impossible.

JP-63-004949 describes apparatus of the type defined in the preamble to the claims, but the moving surface is treated with an air jet and thus does not deal with the problems associated with the use of liquid as treating agent. Furthermore, air as treating agent is quite insufficient to achieve efficient and complete cleaning of the object. The air jet is not strong enough to break up hard layers of impurities on a moving surface and there is a risk of dust and other impurities being pressed out through the air gaps in the suction nozzle. The nozzle for the air jet is also mounted in the wall of the suction nozzle and the latter is asymmetrical in shape to extend obliquely into the chamber, so that the flow of air and impurities becomes uneven and difficult to control, particularly axially and radially inside the air gap. U.S. Pat. No. 3,737,940 describes a device based on mechanical cleaning with the aid of a rotating brush or soft roller journalled in a housing that extends longitudinally in the axial direction of the roll. The surface of the roll is sprayed with liquid, i.e. under negligible pressure, both before and after the brush. Such a device is complicated in design as well as being relatively large and clumsy. The most important drawback, however, is that its cleaning capacity is insufficient and it has little or no effect on hard layers of impurities.

The object of the present invention is to provide an improved apparatus which will enable the moving surface of a duty object to be cleaned while still in continuous operation, i.e. without the object having to be stopped and possibly removed and replaced for reconditioning for its specific function, and which is so efficient that even hard layers of impurities can be removed from the object, and which also leaves a dry moving surface although liquid is used as treating agent.

The apparatus according to the invention is characterized substantially in that the jet nozzle is arranged at a distance from the inside of the suction nozzle and at or close to the centre of the suction nozzle to form a free circumferential passage of the chamber between the inside and the jet nozzle, said passage communicating with said evacuation pipe, and that the nozzle head includes means for supplying compressed air into the chamber via said gap in order to encounter and carry with it treatment liquid deflected from the surface and material released from the surface in the direction to and through said passage in cooperation with the suction effect maintained in the chamber and evacuation pipe.

The invention will be described in more detail in the following with reference to the accompanying drawings.

DETAILED DESCRIPTION OF THE INVENTION

Figure 2:
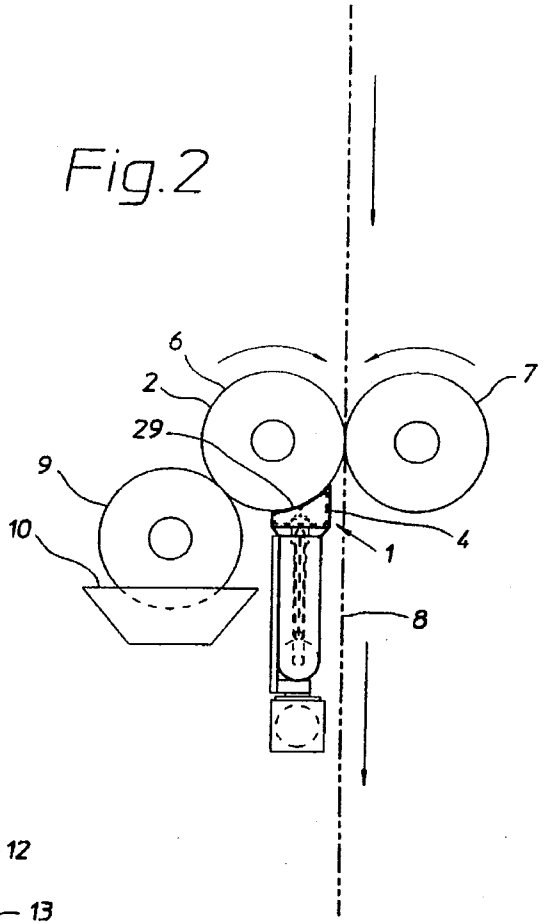
FIG. 2 is an end view of the cleaning unit according to FIG. 1.
Figure 1:
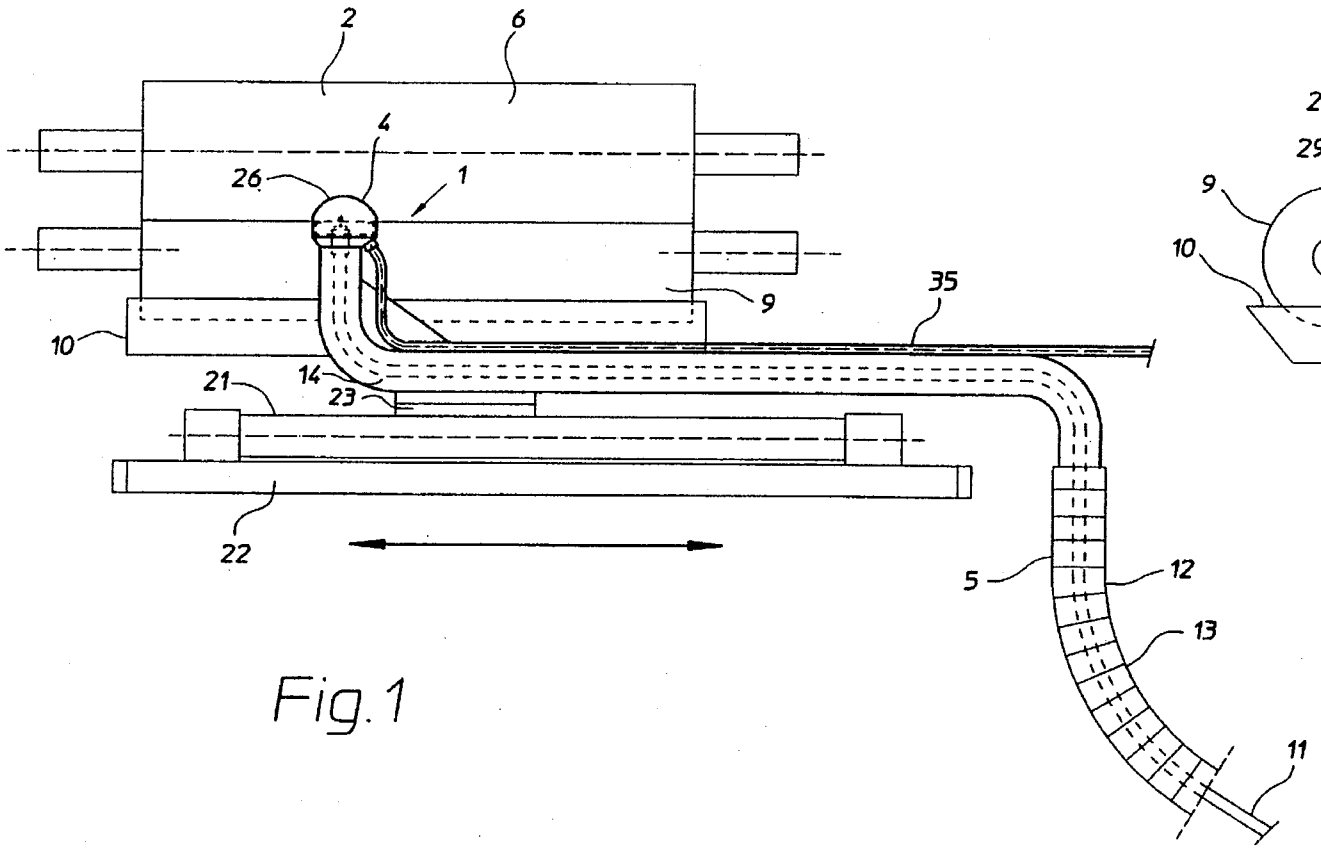
FIG. 1 is a lateral view of a cleaning unit of the apparatus according the invention, with a nozzle head displaced from the centre of a pattern roll.
Figure 3:
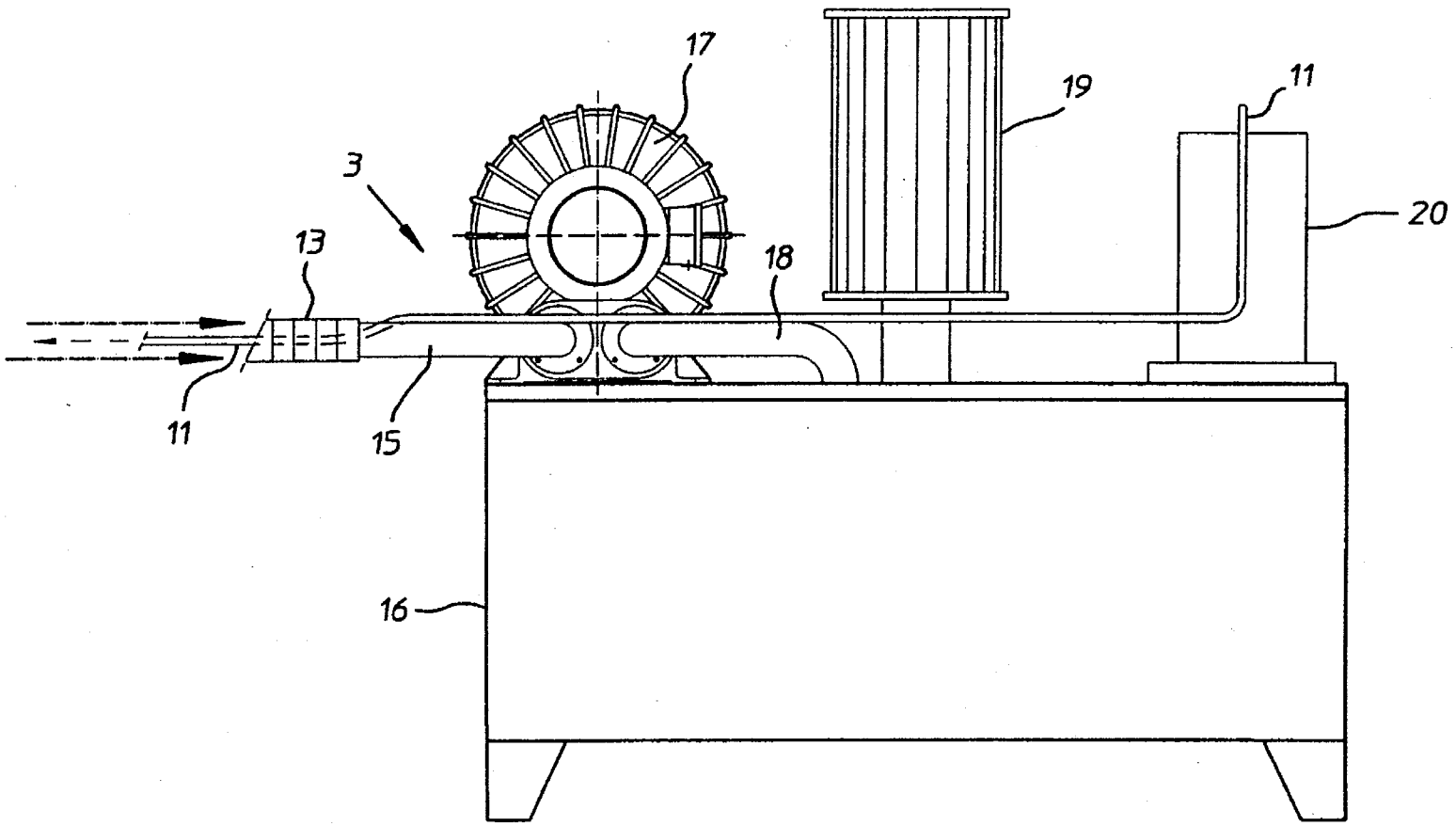
FIG. 3 is a service unit of the apparatus according to the invention, for serving the cleaning unit according to FIG. 1.

With reference to FIGS. 1 and 2 it is shown therein schematically a cleaning unit 1 of an apparatus according to the invention for cleaning a surface 2 in movement, whereas FIG. 3 shows schematically a service unit 3 of the apparatus to serve the cleaning unit 1. The cleaning unit 1 comprises a nozzle head 4 connected to the service unit via pipe means 5. In the embodiment shown the moving surface 2 to be cleaned consists of the shell surface of a rotating pattern roll 6 which forms a nip with a counter roll 7, a paper web 8 passing through the nip where printing is effected on the side in contact with the pattern roll 6. Ink is supplied to the pattern roll 6 by an inking feed roller 9, the shell surface of which passes through an ink solution in a trough 10.

The pipe means 5 comprise a supply pipe 11 for fresh treating liquid, e.g. water or some other solvent, and an evacuation pipe 12 for spent liquid which now contains impurities, i.e. ink and loose fibres from the paper web in the case described, as well as dirt and dust. The evacuation pipe 12 is provided with an intermediate portion 13 which is flexible, and end portions 14, 15 at the two units 1, 3, which are rigid and bent in suitable manner. The supply pipe 11 for fresh treating liquid extends inside the evacuation pipe 12 and may consist of a hose.

The service unit 3 includes a tank 16 containing fresh treating liquid in one or more containers, and equipment for cleaning used liquid containing impurities. Above the tank 16 is a vacuum pump 17 to which the evacuation pipe 12 is connected by its end portion 15, the vacuum pump 17 being connected to said cleaning equipment in the tank 16 by means of a return pipe 18. An air filter 19 is connected to the cleaning equipment to let out air separated from the liquid containing impurities and supplied at the cleaning unit 1 to serve as carrier for the liquid used and impurities released. A high-pressure pump 20 arranged above the tank 16 is connected to the clean treating liquid in the tank 16. The hose 11 is connected to the high-pressure pump 20 which is thus arranged to feed clean treating liquid to the nozzle head 4 via the hose 11.

Figure 4:
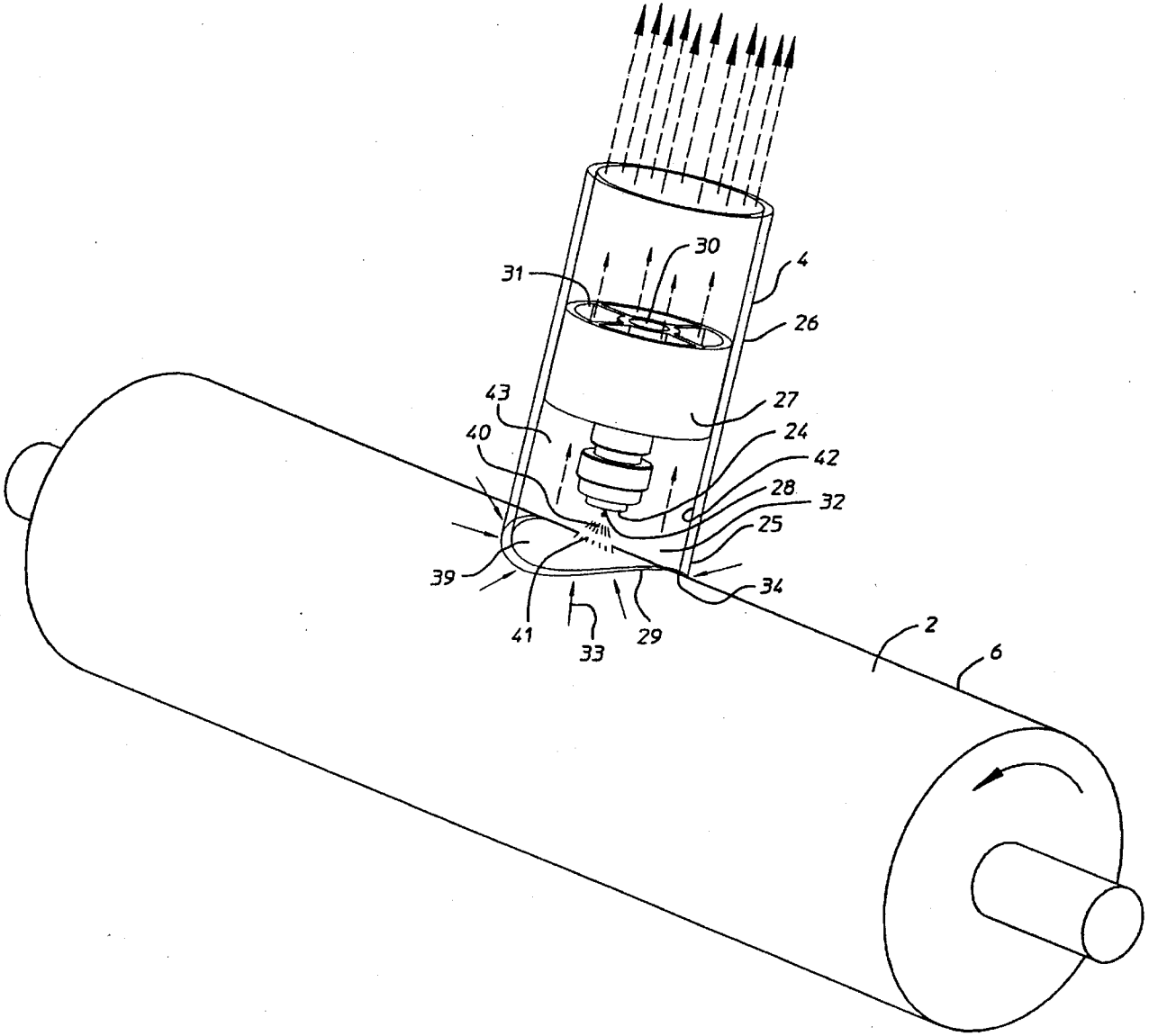
FIG. 4 is a perspective view of a nozzle head substantially similar to that in FIG. 1, but directed towards the centre of a pattern roll to be reconditioned.
Figure 5:
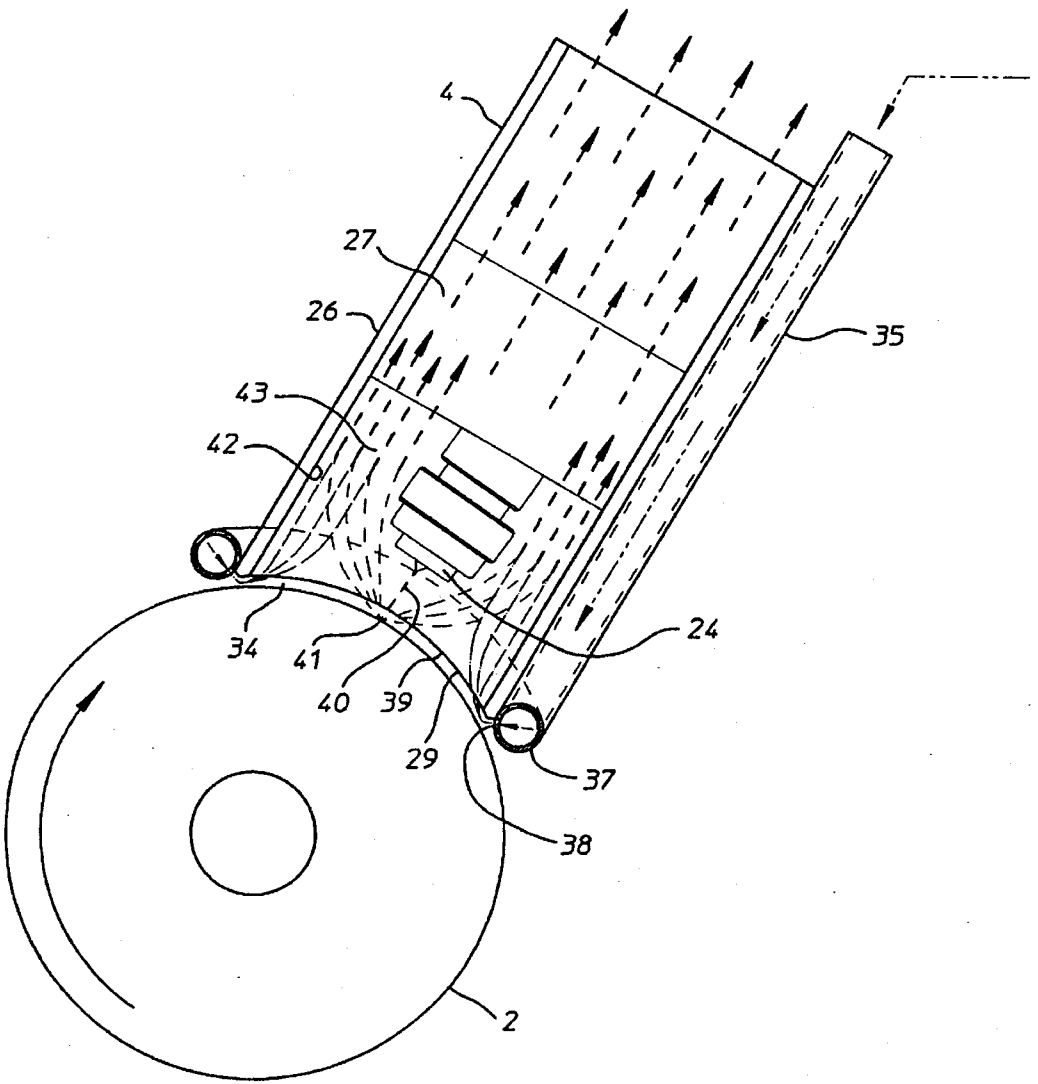
FIG. 5 is an end view of the nozzle head and pattern roll according to FIG. 4.

The nozzle head 4 can be moved parallel to the shaft of the pattern roll 6 in a to and fro movement effected by an actuator 21 in the form of a pneumatic or hydraulic cylinder rigidly mounted on a stand 22 (not shown in FIG. 2). The plunger in the cylinder 21 is rigidly connected to the bent, rigid end portion 14 of the evacuation pipe 12 via a connection piece 23. The nozzle head 4 is rigidly connected to the end portion 14 so that the nozzle head 4 is guided along the shell surface 2 at a constant distance therefrom to ensure a gap 34, as will be explained further below. In the embodiment according to FIGS. 1 and 2 the centre line of the nozzle head 4 is somewhat displaced from the centre of the pattern roll 6, whereas the nozzle head 4 in the embodiment according to FIGS. 4 and 5 is directed exactly towards the centre.

The nozzle head 4 (see FIGS. 4 and 5) includes a housing 25 consisting of a casing with circular cross section, and a jet nozzle 24 arranged in the casing 25 in the immediate vicinity of the centre line of the casing. The casing 25, which is preferably cylindrical, itself forms an elongate suction nozzle 26 which terminates in an orifice edge 29 surrounding an opening 39 free from mechanical parts. The suction nozzle 26 contains a chamber 32 comprising said opening 39 and is arranged spaced from the shell surface 2 to form a circumferential gap 34 between the shell surface 22 and orifice edge 29. The jet nozzle 24 is arranged in the chamber 32 of the casing, spaced axially from the opening 39, to emit a jet 40 of treating liquid producing a predetermined treatment area 41 on the shell surface 2. A holder 27 is mounted inside the casing 25, the location of which may be fixed but is preferably adjustable to different positions with the aid of a suitable adjustment means (not shown). The holder 27 carries the jet nozzle 24, the orifice 28 of which is located centrally in the casing 25. The position of the jet nozzle 24 in relation to the holder 27 may be fixed or adjustable. The hose 11 is connected to a central, axial aperture 30 in the holder 27, this aperture 30 communicating with the jet nozzle 24. The holder 27 is also provided with a plurality of peripheral, axial through-holes 31 through which the evacuation pipe 12 communicates openly with the chamber 32 of the suction nozzle 26. The front end of the suction nozzle 26 is shaped with a contour to fit the curvature of the pattern roll 6 to produce said gap 34. This contour thus varies in shape depending on the alignment of the suction nozzle 26 in relation to the centre of the pattern roll, as illustrated by the two embodiments in FIG. 2 and FIG. 5.

During linear displacement of the nozzle head 4 this is guided by its suspension in the cylinder 21 so that the size of the gap 34 is kept constant all the time.

According to the present invention the jet nozzle 24 is arranged spaced from the cylindrical inner side 42 of the suction nozzle 26 so that a free, circumferential passage 43 of the chamber 32 is formed between the inner side 42 and the jet nozzle 24. This passage 43 thus communicates directly with the evacuation pipe 12 via the axial apertures 31 in the holder 27.

According to the present invention the nozzle head 4 also includes means 44 for a controlled supply of compressed air to the chamber 32 via said gap 34 in order to encounter and carry with it liquid deflected from the surface 2 and material released from the shell surface 2 towards and through said passage 43. The supply means 44 for compressed air includes a pipe 35 and a distributor connected to the pipe 35 for forced supply of compressed air to the suction nozzle 26 close to the orifice edge 29 so that a strong flow of air is introduced into the chamber 32 through the gap 34. The increased air flow also results in favourable drying of the shell surface 2. The compressed air may be supplied all around the gap 34 or only to certain parts of it, particularly downstream of the orifice edge 29 in that case when the pattern roll 6 or other object is rotating with such high speed that its surface 2 carries with it a layer of air into the chamber 32 through the gap 34 upstream of the orifice edge 29, seen in the direction of rotation of the pattern roll. The compressed air jets are thus aligned so that they hit the shell surface 2 upon passage through the gap 34. A suitable alignment is thus about 40°–90° in relation to the outer surface of the casing 25. The distributor is not shown in FIG. 4 but is generally intimated by arrows 33 to illustrate the distribution of the compressed air downstream of the orifice edge 29. In FIG. 5 the distributor is shown in the form of an endless pipe 37 extending around the entire suction nozzle 26, close to the orifice edge 29, and provided with a plurality of apertures 38 facing towards the gap 34 so that jets 45 of compressed air are forced into the chamber 32 via the gap 34 at the same time as hitting the shell surface 2 to dry it.

Figure 6:
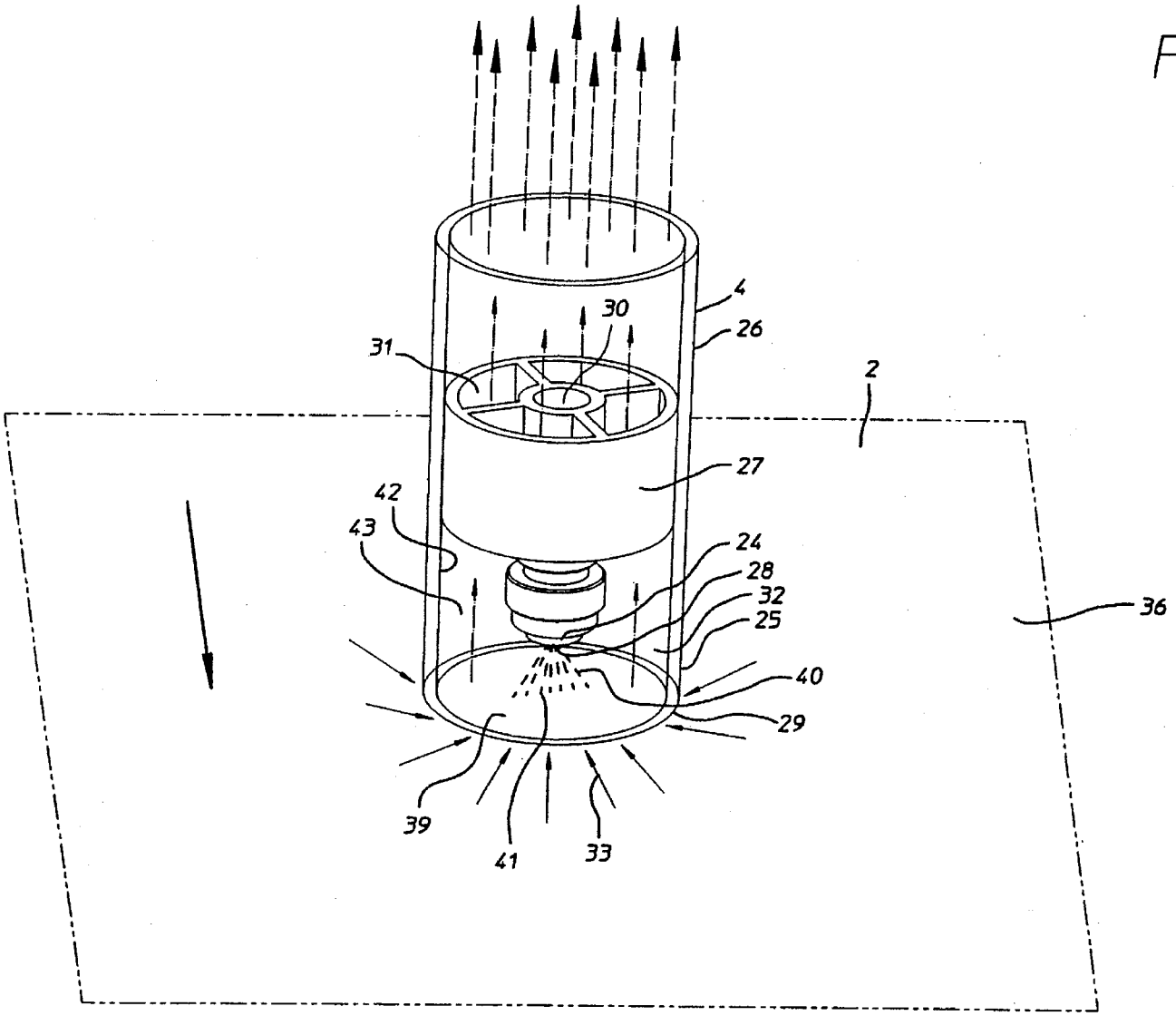
FIG. 6 is a perspective view of a nozzle head arranged to clean a flat section of an object running over at least two rolls.

FIG. 6 shows a nozzle head 4 similar to that in FIG. 4 but modified to treat the flat surface 2 of a moving wire or felt 36 in a paper machine in operation. The only difference is that the orifice edge 29 of the casing 25 has been made flat instead of concave so that the orifice edge 29 lies in a plane perpendicular to the central axis of the nozzle head 4. A nozzle head of the type shown in FIG. 4, i.e. with an inwardly curving orifice edge 29, can also be used to great advantage for cleaning a wire or felt 36 by being mounted next to a curved surface of the wire or felt, i.e. where it runs over a roll. A greatly improved result is obtained since the wire or felt exposes inner portions as it passes and is bent around a roll and the liquid jet 40 also acts on these inner portions of the surface 2.

The term "impurities" refers to all material that, particularly during operation, adheres to the surface 2 of the object 6 and includes not only particles such as dust and dirt from the surroundings and fibres from the material web, e.g. paper web, in contact with the moving surface, but also such material which, with the aid of the moving surface, is to be applied on a passing web of material, or which is already on the web of material.

The liquid used for cleaning the surface 2 of the object 6 may be any suitable liquid whatsoever, depending on the nature of the moving surface to be cleaned. The liquid may be at ambient temperature or increased temperature. It is totally free from solid particles since these might damage the surface 2 of the object 6. In most cases it is sufficient to use fresh water.

The apparatus also includes a control unit (not shown) which influences the actuator 21 and controls the movements of the nozzle head 4 to and fro in relation to the velocity of the roll, wire, felt or other object 6 so that the entire surface 2 is treated and cleaned within a certain period of time. The rate of feed of the nozzle head 4 across the direction of movement of the object is selected in proportion to the effective dimension of the treatment area 41 (transversely over the object 6). If the latter is for instance 10 mm, the feed rate may be at most 8 mm per revolution. With the aid of a step motor, for instance, or some other suitable actuator, the control unit can be programmed to control the nozzle head 4 to clean only, or more frequently, specific parts of a roll, for instance.

If desired the apparatus may be provided with one or more additional nozzle heads 4 in order to increase its capacity.

The shape of the treatment area 41, determined by the shape of the opening 28, may be oblong with little width, which is preferred, or oval or circular. The largest effective dimension of the treatment area 41 is generally perpendicular to the direction of movement of the object 6 and is suitably 1–50 mm, preferably 5–10 mm, depending on prevailing operating conditions. The diverging shape of the jet 40 then encompasses an angle of about 5°–50°. The larger the angle the greater must be the shortest distance of the treatment area 41 to the gap 34. If the angle is 45°, therefore, this distance is at least about 15–20 mm.

The treating liquid supplied to the jet nozzle 24 has a pressure of 50–500 bar, preferably 150–300 bar, depending on the prevailing operating conditions. The liquid jet 40 thus hits the object 6 at a very high pressure and the liquid jet 40 thus has a mechanical effect in that it breaks up impurities on the object and knocks them loose, thereafter taking the impurities with it. At the same time the surface of the object is washed with treating liquid when the jet 40 hits the surface, and at least some of the impurities may dissolve immediately in the liquid or during evacuation.

The quantity of liquid used is suitably 0.12–5 l/min, preferably 0.5–1.5 l/min, for each nozzle head 4, depending on the prevailing operating conditions.

The size of the gap 34, i.e. the distance between the orifice edge 29 and the surface 2 of the object 6 is suitably 1–5 mm, preferably 1.5–3.0 mm, depending on the prevailing operating conditions.

The distance of the jet nozzle 24 to the surface 2 of the object 6 is suitably 2–20 mm, preferably 2–5 mm, depending on the prevailing operating conditions. However, it should never be less than the size of the gap 34 in any operating case.

The limit of the treatment area 41 produced by the liquid jet 40 is located at a distance from the gap 34 to prevent liquid and impurities squirting out through the gap 34 and also to enable compressed air to be forced in through the gap 34 so that a flow of air will entirely surround the liquid jet 40 and be deflected up towards and through the passage 43 to serve as transport air for the used deflected liquid and impurities. Said distance is at least 10 mm.

In order to ensure a uniform flow of liquid, air and impurities past the jet nozzle 24, as well as an efficient flow of air away from the gap 34 into the chamber 32, it is also important for the jet nozzle 24 to be arranged in or close to the centre of the casing 25. The jet nozzle 24 or just its orifice 28 can be adjusted so that the liquid jet 40 forms an angle of 0°–45° with the centre line of the casing 25, the liquid jet 40 thus forming an angle of less than 90° with the tangent at the point where the liquid jet impacts the roll, seen against the direction of rotation. Depending on the alignment of the jet nozzle 24, the centre of the treatment area 41 can be moved from 0 to 20 mm towards the upstream part of the gap 34 in order to compensate for the speed of rotation of the roll.

It will be understood that in the evacuation pipe 12 and associated chamber 32 the subpressure is regulated to a level at which the necessary suction force is created in order to evacuate all liquid, air and impurities backwards from the suction nozzle 26 and through the evacuation pipe 12 without any liquid, air or impurities penetrating out through the gap 34.

Thus, the invention provides an efficient apparatus for cleaning rotating rolls and wires, for instance, without the aid of mechanical construction elements working on the surface. The invention enables rolls to be cleaned with liquid jets at extremely high pressure while still obtaining a dry surface. The apparatus thus provides a combined cleaning and drying effect.

I claim:

1. Apparatus for cleaning a surface of an object moving in a first direction, said apparatus comprising:

at least one nozzle head, comprising a housing forming an elongated suction nozzle, including a center, that terminates at a first end thereof in an orifice edge, which orifice edge surrounds and defines an opening; a chamber including said opening; and at least one jet nozzle disposed in said chamber spaced from said opening and capable of emitting a jet of treatment liquid;

said nozzle head positioned with respect to the surface of an object to be cleaned so that a circumferential gap is formed between the surface to be cleaned and said orifice edge, and so that said jet of treatment liquid impacts a treatment area of the surface to be cleaned;

an evacuation pipe connected to said chamber of said suction nozzle;

a supply pipe connected to said jet nozzle for supplying treatment liquid under superatmospheric pressure thereto;

a vacuum source connected to said chamber by said evacuation pipe for maintaining a sub-pressure in said chamber so that said vacuum source, along with air flowing through the gap between said nozzle head and the surface to be cleaned, evacuates liquid and material released from the surface from said chamber;

an actuator for moving said nozzle head in a second direction substantially perpendicular to the first direction, said nozzle head guided during movement by said actuator so as to maintain the gap between said nozzle head and the surface to be cleaned;

said jet nozzle disposed within said suction nozzle at a position at or near the center of said suction nozzle to define an open circumferential passage between an interior wall portion of said jet nozzle and said suction nozzle, said open circumferential passage connected to said evacuation pipe; and means for supplying compressed air into said suction nozzle chamber through the gap between said nozzle head and the surface of the object to be cleaned so that the compressed air encounters and carries with it treatment liquid deflected from the surface of the object to be cleaned, and material released from the surface of the object to be cleaned, into and through said open circumferential passage and under the influence of said vacuum source.

2. Apparatus as recited in claim 1 wherein said suction nozzle has a circular cross-section.

3. Apparatus as recited in claim 1 wherein said means for supplying compressed air is mounted in a position in which it supplies compressed air into said suction nozzle chamber only at that part of the gap defined between said nozzle head and the surface of the object to be cleaned located downstream, in the first direction of said nozzle head, in the gap.

4. Apparatus as recited in claim 1 further comprising a service unit, said service unit comprising said vacuum source, a tank for storing cleaning liquid, a high pressure pump connected to said supply pipe and said tank, and connected to said evacuation pipe means for receiving polluted liquid from said evacuation pipe and separating impurities and transport air from the polluted liquid.

5. Apparatus as recited in claim 1 wherein said housing comprises a tubular casing; and further comprising a holder disposed within said tubular casing centrally mounting said jet nozzle therein, a plurality of peripheral, axial, through-extending openings being provided in said holder surrounding said jet nozzle and defining said open circumferential passage.

6. Apparatus as recited in claim 5 wherein a position of said holder within said tubular casing is adjustable to thereby allow adjustment of the position of said jet nozzle with respect to said orifice edge.

7. Apparatus as recited in claim 1 wherein said means for supplying compressed air comprises a distributor extending around at least a portion of said orifice edge, and having a plurality of openings facing the gap between said nozzle head and the object to be cleaned.

8. Apparatus as recited in claim 7 wherein said distributor comprises a pipe.

9. Apparatus as recited in claim 1 wherein said jet nozzle emits a diverging liquid stream encompassing an angle of 5°–50°.

10. Apparatus as recited in claim 1 further comprising a control unit for controlling said actuator in response to a velocity and size of the surface to be cleaned to insure effective cleaning after a predetermined period of time.

11. A combination comprising:

an object having a surface to be cleaned, said surface moving in a first direction; and a cleaning apparatus for cleaning said surface, said cleaning apparatus comprising: at least one nozzle head, comprising a housing forming an elongated suction nozzle that terminates at a first end thereof in an orifice edge, which orifice edge surrounds and defines an opening a center, and a chamber including said opening, and at least one jet nozzle disposed in said chamber spaced from said opening and capable of emitting a jet of treatment liquid; said nozzle head positioned with respect to said surface so that a circumferential gap is formed between said surface and said orifice edge, and so that said jet of treatment liquid impacts a treatment area of said surface; an evacuation pipe connected to said chamber of said suction nozzle; a supply pipe connected to said jet nozzle for supplying treatment liquid under superatmospheric pressure thereto; a vacuum source connected to said chamber by said evacuation pipe for maintaining a sub-pressure in said chamber so that said vacuum source, along with air flowing through the gap between said nozzle head and said surface, evacuates liquid and material released from said surface from said chamber; an actuator for moving said nozzle head in a second direction substantially perpendicular to the first direction, said nozzle head guided during movement by said actuator so as to maintain said gap; said jet nozzle disposed within said suction nozzle at a position at or near the center of said suction nozzle to define an open circumferential passage between an interior wall portion of said suction nozzle and said jet nozzle, said open circumferential passage connected to said evacuation pipe; and means for supplying compressed air into said suction nozzle chamber through said gap so that the compressed air encounters and carries with it treatment liquid deflected from said surface, and material released from said surface, into and through said open circumferential passage and under influence of said vacuum source.

12. A combination as recited in claim 11 wherein said gap has a size; and wherein said nozzle head is positioned with respect to said surface so that the size of said gap is between 1–5 mm.

13. A combination as recited in claim 12 wherein said gap has a size; and wherein there is a distance between said jet nozzle and said surface; and wherein the distance between said jet nozzle and said surface is between 2–20 mm, and greater than the size of said gap.

14. A combination as recited in claim 13 wherein there is a treatment area of said liquid jet from said jet nozzle on said surface, which treatment area is spaced from said gap less than 10 mm.

15. A combination as recited in claim 11 wherein said gap has a size; and wherein said nozzle head is positioned with respect to said surface so that the size of said gap is between 1.5–3 mm.

16. A method of cleaning a surface, using a nozzle head including a suction nozzle terminating at a first end thereof in an orifice edge which surrounds and defines an opening, a chamber including the opening, and a jet nozzle for emitting a jet of treatment liquid, said method comprising the steps of:

(a) positioning the nozzle head with respect to the surface so that a circumferential gap is formed between the surface and the orifice edge and so that a liquid jet from the jet nozzle impacts a treatment area of the surface;

(b) moving the surface in a first direction;

(c) as the surface is moving simultaneously: (c1) supplying cleaning liquid to the jet nozzle and directing the cleaning liquid with the jet nozzle onto the surface predetermined area; (c2) applying a suction force to the chamber to withdraw gas, liquid, and entrained material, away from the surface through the chamber; and (c3) supplying compressed air to the gap to encounter and carry with it treatment liquid and material cleaned off the surface; and (d) moving the nozzle head in a second direction substantially perpendicular to the first direction while practicing steps (c1)–(c3).

17. A method as recited in claim 16 wherein step (c1) is practiced so as to direct liquid at a pressure of between about 150–300 bar from the jet nozzle.

18. A method as recited in claim 17 wherein step (c1) is practiced so as to emit treatment liquid from the jet nozzle at a rate of between about 0.5–1.5 liters per minute.

19. A method as recited in claim 18 wherein step (a) is practiced so that the gap has a size that is between about 1.5–3 mm, and so that the jet nozzle and the moving surface are spaced a distance that is between about 2–5 mm and greater than the size of the gap.

20. A method as recited in claim 16 wherein the surface to be cleaned is a peripheral surface of a roll, and wherein step (b) is practiced by rotating the roll about an axis of rotation, and wherein step (d) is practiced by linearly reciprocating the nozzle head in a substantially horizontal direction subatantially parallel to the axis of rotation of the roll.

* * * * *